US007546815B2

(12) United States Patent
Mazzei et al.

(10) Patent No.: US 7,546,815 B2
(45) Date of Patent: Jun. 16, 2009

(54) ACTUATED WARNING FLAG FOR BOATING

(76) Inventors: Michael Mazzei, 3500 Candlewood Dr., Bakersfield, CA (US) 93306; Tamara Mazzei, 3500 Candlewood Dr., Bakersfield, CA (US) 93306; Michael Mazzei, 3500 Candelwood Dr., Bakersfield, CA (US) 93306

( * ) Notice: Subject to any disclaimer, the term of this patent is extended or adjusted under 35 U.S.C. 154(b) by 91 days.

(21) Appl. No.: 11/824,831

(22) Filed: Jul. 2, 2007

(65) Prior Publication Data

US 2008/0000412 A1 Jan. 3, 2008

Related U.S. Application Data

(60) Provisional application No. 60/818,359, filed on Jul. 3, 2006.

(51) Int. Cl.
*G08B 5/14* (2006.01)
*G09F 17/00* (2006.01)

(52) U.S. Cl. ..... 116/303; 116/173

(58) Field of Classification Search ..... 116/28 R, 116/39, 51, 173, 174, 209, 284, 285, 303; 114/253
See application file for complete search history.

(56) References Cited

U.S. PATENT DOCUMENTS 2,579,292 A * 12/1951 Brelsford ..... 340/328
2,972,326 A * 2/1961 Simpson ..... 441/69
3,171,988 A * 3/1965 Donahue ..... 137/625.67
3,798,631 A * 3/1974 Langford ..... 340/502
3,941,340 A 3/1976 Rankins
4,122,796 A 10/1978 Pressler et al.
4,599,965 A * 7/1986 Johnson ..... 116/209
4,640,213 A 2/1987 Lugo
4,782,784 A 11/1988 Little
4,934,972 A * 6/1990 Shumway et al. ..... 441/69
4,962,720 A 10/1990 Leffel
5,304,993 A 4/1994 Handsaker
5,408,221 A 4/1995 Carsella, Sr. et al.
5,550,531 A 8/1996 Little-Lowry
5,771,836 A 6/1998 Crouse
6,057,787 A 5/2000 Kell et al.
6,250,248 B1 6/2001 Patera
RE37,823 E * 9/2002 Larson et al. ..... 114/253
6,584,927 B1 * 7/2003 Iversen et al. ..... 116/173
7,059,690 B1 * 6/2006 Pinkston ..... 116/51
7,428,879 B1 * 9/2008 White et al. ..... 116/303
2006/0054067 A1 * 3/2006 Hoberman et al. ..... 114/145 R
2008/0035049 A1 * 2/2008 Johnston et al. ..... 116/173

* cited by examiner

*Primary Examiner*—R. A. Smith
(74) *Attorney, Agent, or Firm*—James M. Duncan, Esq.; Klein, DeNatale, Goldner, et al.

(57) ABSTRACT

A pneumatically activated signal flag is used in combination with a first watercraft to provide a visual warning to other watercraft operators of various events which may be occurring around the first watercraft. For example, the signal flag may indicate that a swimmer is in the water adjacent to the watercraft. The signal flag is raised or lowered by activation of a pneumatic activating ram by an operator within the water craft.

8 Claims, 5 Drawing Sheets

ACTUATED WARNING FLAG FOR BOATING

CROSS-REFERENCE TO RELATED APPLICATION

U.S. Provisional Application No. 60/818,359 for this invention was filed on Jul. 3, 2006 for which the inventors claim domestic priority.

BACKGROUND OF THE INVENTION

The present invention generally relates to safety devices for recreational boating and more particularly to a signal flag which is connected to an actuation device for raising and lowering the flag upon activation of switching means.

Various state laws and regulations require the use of a warning flag when water skiing or other water recreational activities are taking place. For example, Title 14 of the California Code of Regulations section 7009 requires that a red or orange flag in the shape of a square or a rectangle, measuring no less than 12 inches on each side, be mounted or displayed in such a manner as to be visible in every direction when any one of the following activities are taking place: (1) a water skier is downed; (2) a skier is in the water preparing to ski; (3) a ski line is extended from the vessel; or (4) a ski is in the water in the vicinity of the vessel. Section 7009 further states that the flag shall not be displayed at any other time. In addition, flags are usually required to be used when a person is in the water around a boat swimming, inner tubing, or wake boarding. Other jurisdictions have similar requirements. Some jurisdictions require that a flag be raised when a boat is towing fishing lines. However, even in the absence of legal obligations, common sense dictates that other watercraft operators be warned when persons or equipment are in the water, or when a watercraft is engaged in certain activities which present a potential hazard to persons or property.

Because of the safety considerations, it is important that the flag remain visible whenever any of the above events are occurring, and lowered when the activity has ceased and the hazard no longer is present. However, as anyone who has participated in water skiing understands, the flag often must be displayed for prolonged periods of time, particularly when an inexperienced skier is in the water learning to ski. Typically, a person will hold the flag aloft. However, over time, the flag holder may start allowing the flag to droop such that the flag is not seen as easily as when the activity first began.

In an effort to resolve this problem, various devices have been utilized for holding or raising water skier warning flags. The present invention provides a reliable manner of displaying the warning flag automatically, and easily lowering the flag when it is no longer necessary to be displayed.

SUMMARY OF THE INVENTION

The present invention comprises an actuated signal flag to be used in combination with a watercraft. An embodiment of the invention of the present application comprises a flag mounted on a flag staff, a pivoting member to which the flag staff is attached, a mounting bracket having means for receiving the pivoting member, an actuating ram having a piston member attached to the pivoting member, and means for selectively extending and retracting the piston member from the actuating ram.

One embodiment of the invention utilizes a pneumatically actuated ram, wherein the means for extending and retracting the piston member comprises a pressurized gas storage vessel. A supply line connects the gas storage vessel to the pneumatically actuated ram. Upon activation of a gas supply, gas is allowed to flow into the ram, causing the piston to extend. The extending piston causes the pivoting member to rotate from a first position, in which the flag is in a lowered position, to a second position, in which the flag is in a raised position. Upon further manipulation of the switching means, the flow of air from the storage vessel to the ram is interrupted, and the air allowed to bleed from the ram, causing the flag to rotate from the second position to the first position.

DESCRIPTION OF THE EMBODIMENTS

Referring now to the figures, the disclosed apparatus comprises an actuated signal flag which is utilized in combination with a watercraft, such as a ski boat, fishing boat, jet ski, or other vessel. The actuated signal flag is utilized to provide a warning to surrounding watercraft and vessels that certain activities are occurring, such as warning that persons or equipment are in the water. Therefore, while the figures and following discussion refer to a ski boat 10 as the watercraft, it is to be appreciated that the actuated signal flag may be used in combination with other varieties of watercraft.

Figure 1:
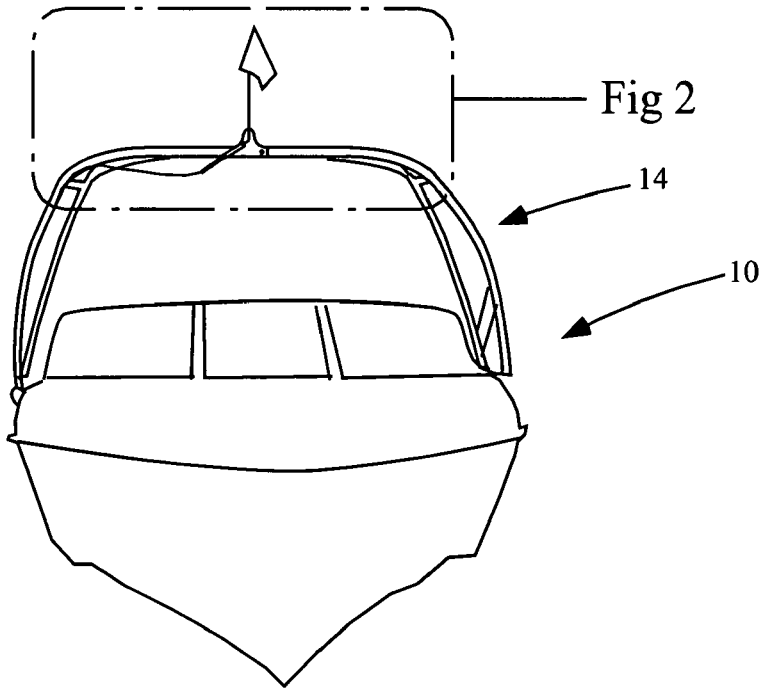
FIG. 1 shows a water craft showing how an actuator, linkage and flag member may be mounted on a tower of the water craft.
Figure 2:
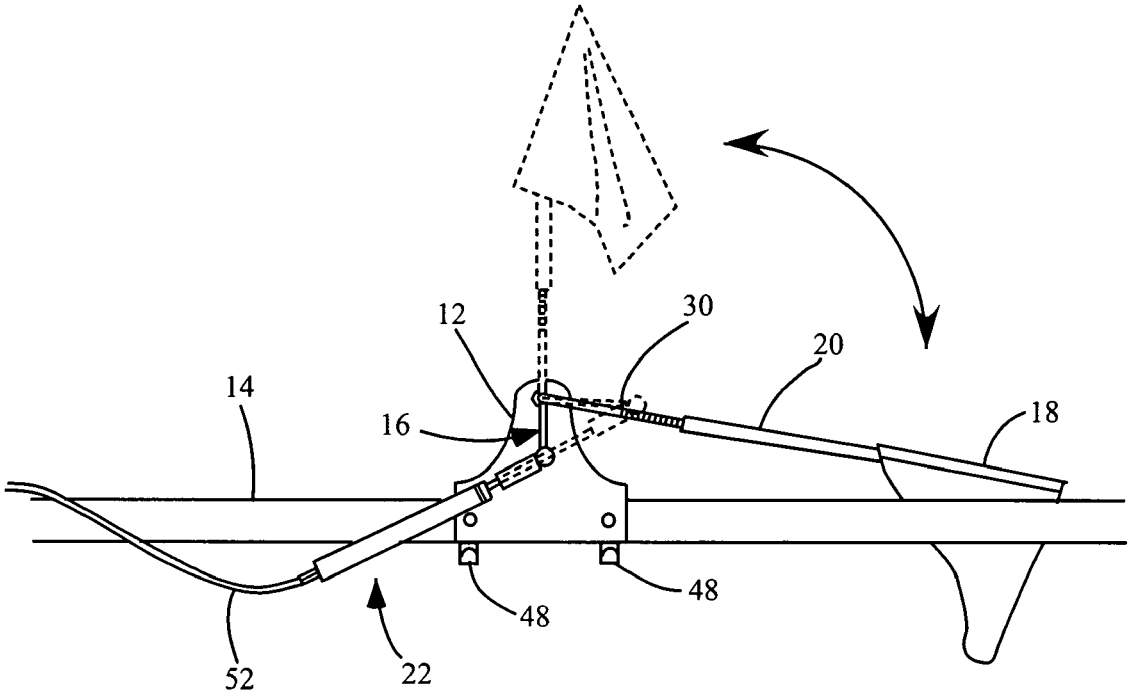
FIG. 2 shows a detailed view of the actuator, linkage and flag member shown in FIG. 1, showing how the flag may be actuated from a first lowered position to a second raised position.
Figure 3:
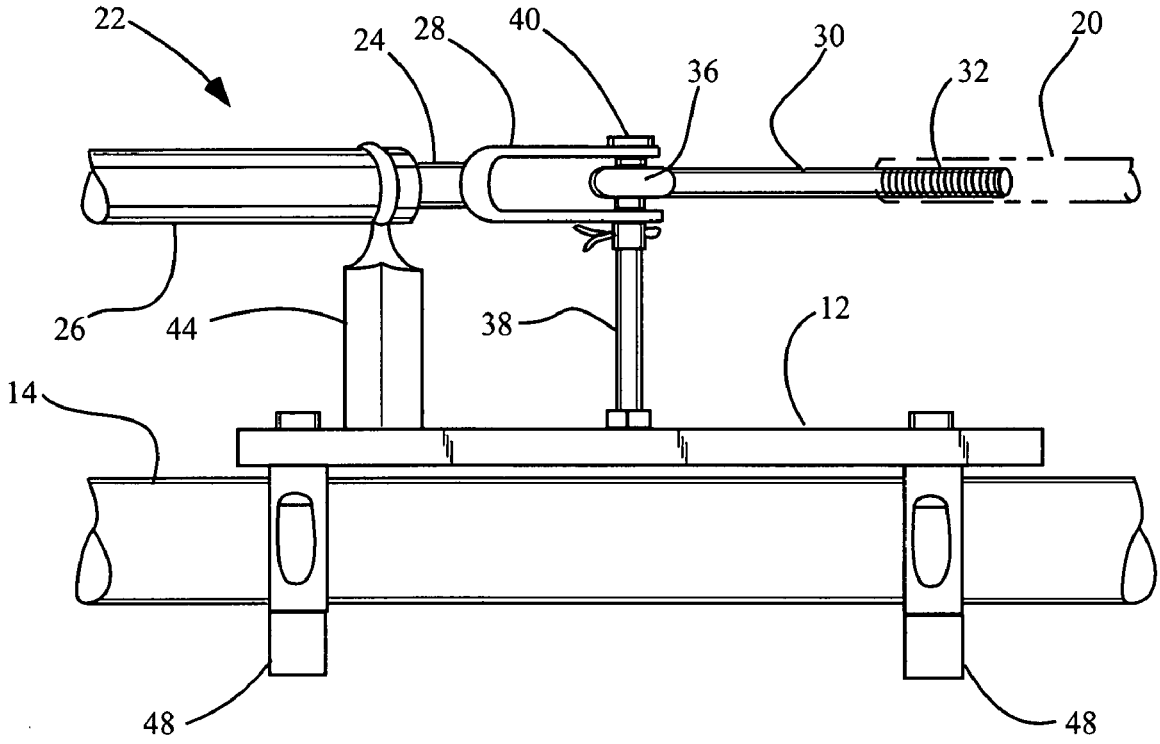
FIG. 3 shows a detailed view of an embodiment of the mounting bracket and pivoting member of an embodiment of the actuated signal flag, viewed from below, showing how the mounting bracket may be mounted to a tower of a water craft.

The actuated signal flag further comprises a mounting bracket 12 which is attached to the ski boat 10. As shown in FIGS. 1 through 3, the mounting bracket 12 may be attached to tower 14 of the ski boat 10. Installing the signal flag on the tower 14 is the preferred location, because the tower is generally the highest point of the vessel to which the flag may be mounted, therefore making it the most visible to other boaters. However, for water craft which do not have towers, mounting bracket 12 may be installed on other locations of the vessel, including the gunwales, forward deck, stem, transom, side panel, etc.

The apparatus comprises a pivoting member 16 which is rotationally attached to mounting bracket 12. Flag 18 may be attached to flag staff 20, which in turn, is attached to pivoting member 16. As shown in FIG. 2, pivoting member 16 may be rotated from a first position, where the flag 18 is in a lowered position, to second position where the flag is in a raised position. A flag receptacle may be mounted on tower 14 or other structure, such that flag 18 is hidden from view when it is in the lowered position, so as to eliminate any confusion whether the signal flag is intended to provide a warning, such as indicating that swimmer or skiers are in the water adjacent to the boat. The flag receptacle may simply comprise an enclosure into which flag 18 drops when pivoting member 16 is rotated into the first position. Alternatively, the flag staff 20 may comprise rotation means which cause the flag staff to unfurl the flag 18 as it is pivoted into the raised position. Conversely, the rotation means would cause the flag 18 to wrap about the flag staff 20 upon being lowered, thus largely hiding the flag from view when in the lowered position.

Rotation of pivoting member 16 is caused by a pneumatic actuating ram 22 which operationally attached to the pivoting member. Pneumatic actuating ram 22 has a piston member 24 which extends from a cylinder member 26 upon introduction of a gas into the cylinder member. The piston member 24 retracts into the cylinder member 26 upon exhausting of gas from the cylinder member. Gas may be exhausted from the cylinder member 26 by means of a vent in the cylinder member or by utilizing an exhaust valve attached to a conduit attached to the cylinder member. The piston member is attached to pivoting member 16, such as with clevis 28. Extension of piston member 24 causes pivoting member 16 to rotate from the first position to the second position. Conversely, retraction of piston member 24 causes pivoting member 16 to rotate from the second position to the first position. As shown best in FIGS. 3-5, pneumatic actuating ram 22 may be secured to mounting bracket 12 with pedestal 44 and clamp ring 46. Mounting bracket 12 may be secured to structural members of tower 14 with clamps 48.

Figure 4:
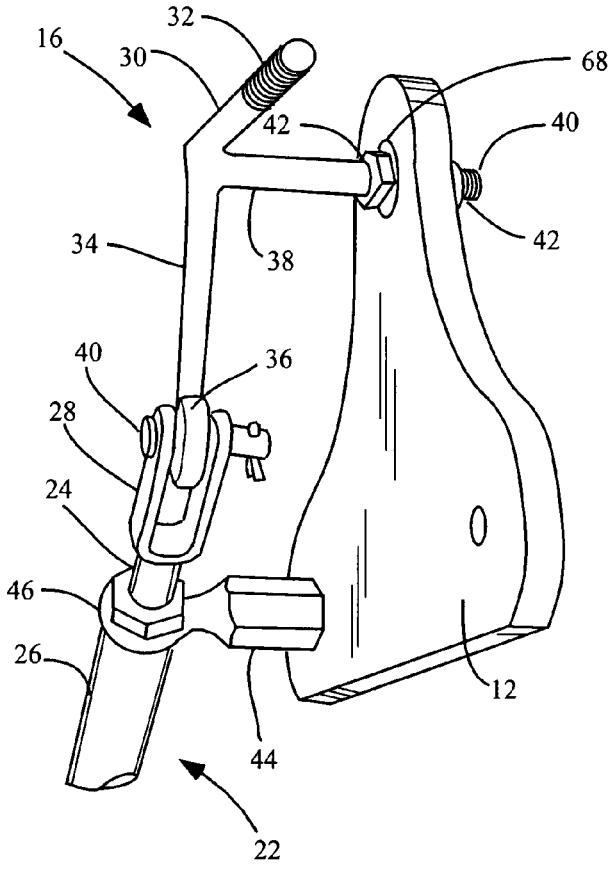
FIG. 4 shows a detailed view of an embodiment of the mounting bracket and pivoting member.
Figure 5:
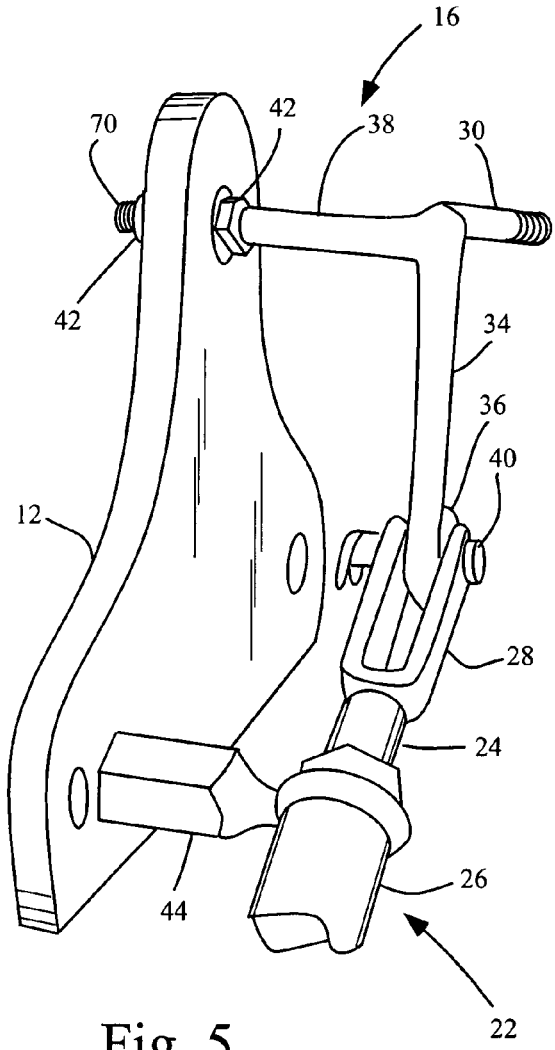
FIG. 5 shows another detailed view of an embodiment of the mounting bracket and pivoting member shown in FIG. 4.
Figure 6:
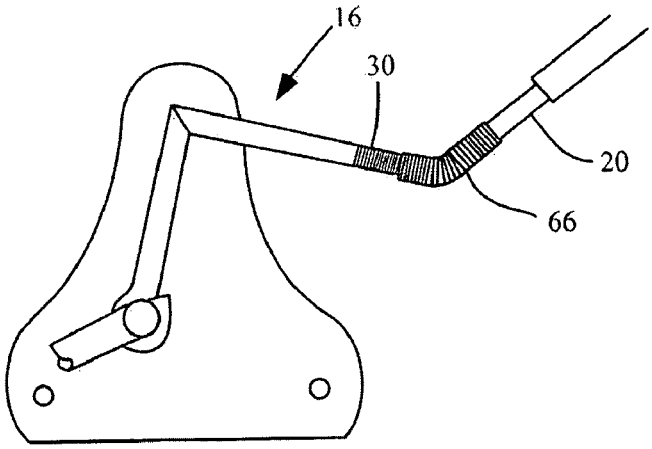
FIG. 6 shows an embodiment of the mounting bracket and pivoting member which utilizes a flexible connector between the pivoting member and flag staff.

As shown in greater detail in FIGS. 4 and 5, pivoting member 16 may comprise three legs. Flag staff 20 may be connected to first leg 30 as shown in FIG. 3. First leg 30 may comprise threads 32 so that flag staff 20 and attached flag 18 may be disconnected from the pivoting member for storage or replacement. Alternatively, flag staff 20 may attach to first leg 30 using a spring-loaded detent and receptacle configuration or other releasable forms of attachment. As shown in FIG. 6, a flexible connector 66, such as a spring, may be utilized between flag staff 20 and first leg 30. The use of flexible connector 66 may prevent or reduce damage to flag staff 20 which may be caused as the flag 18 is raised or lowered, as the pneumatic actuation can rotate the flag rapidly unless otherwise controlled to operate at a slower angular velocity.

As shown in FIGS. 4 and 5, second leg 34 is generally at a right angle to first leg 30. Second leg 34 comprises means for attaching to piston member 24. As shown in the figures, if clevis 28 is attached to piston member 24, second leg 34 may terminate in a loop or eye 36. Pin 40 may then be utilized to attach clevis 28 to eye 36.

Third leg 38 is generally at a right angle to first leg 30 and second leg 34. Assuming that first leg 30 and second leg 34 define a plane, third leg 36 would be generally at a right angle to the plane. Third leg 36 may be attached to mounting bracket 12 with the end of the third leg extending through bearing 68 and retained by fastening means on the opposite side of the mounting bracket 12. Third leg 38 may comprise threads 70 and may be retained to mounting bracket 12 with retaining nuts 42.

Figure 7:
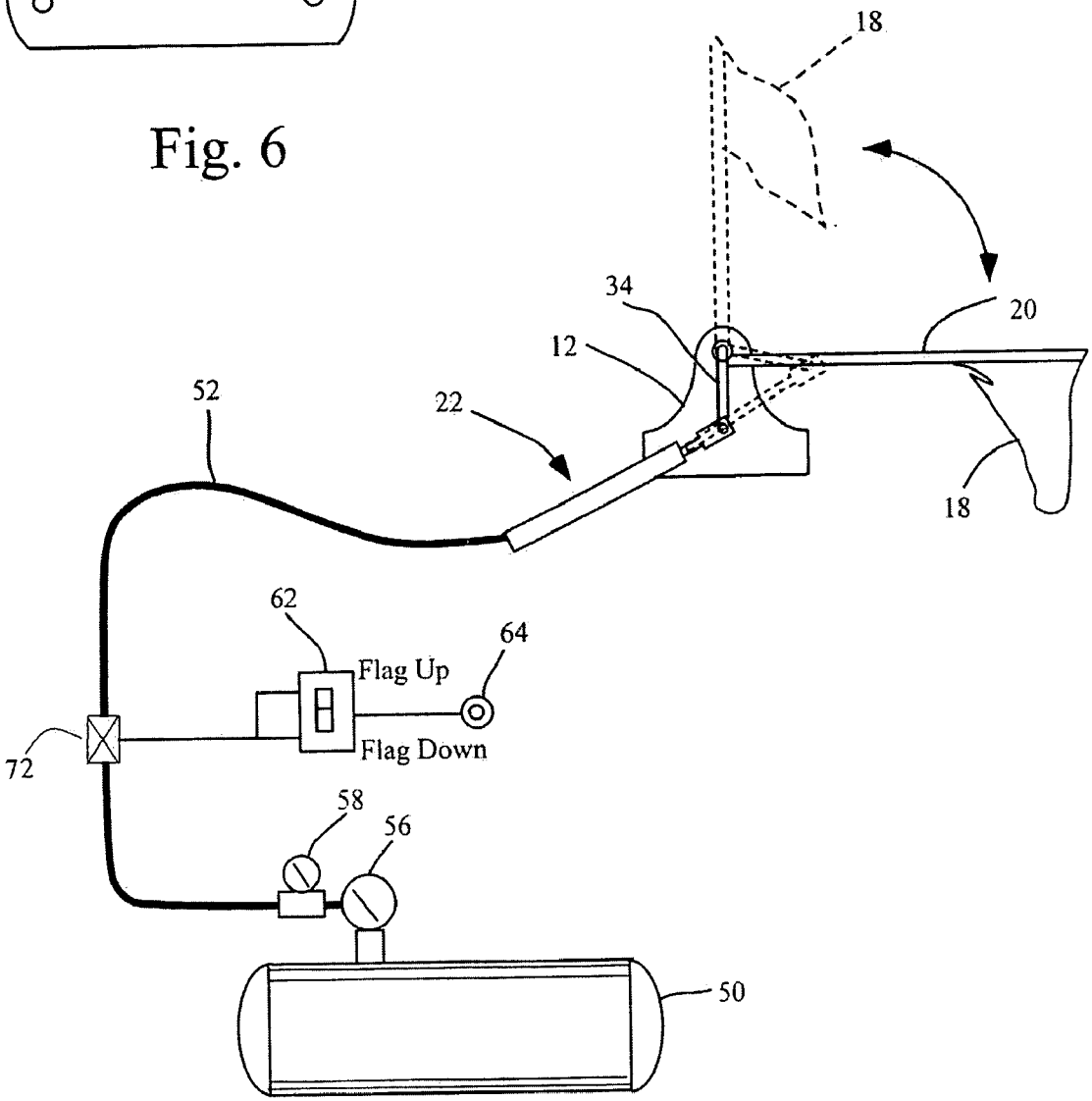
FIG. 7 schematically shows a configuration of a gas storage vessel, remote activation means, position indicator, actuator, mounting bracket, and pivoting member which may be utilized in the present invention.
Figure 8:
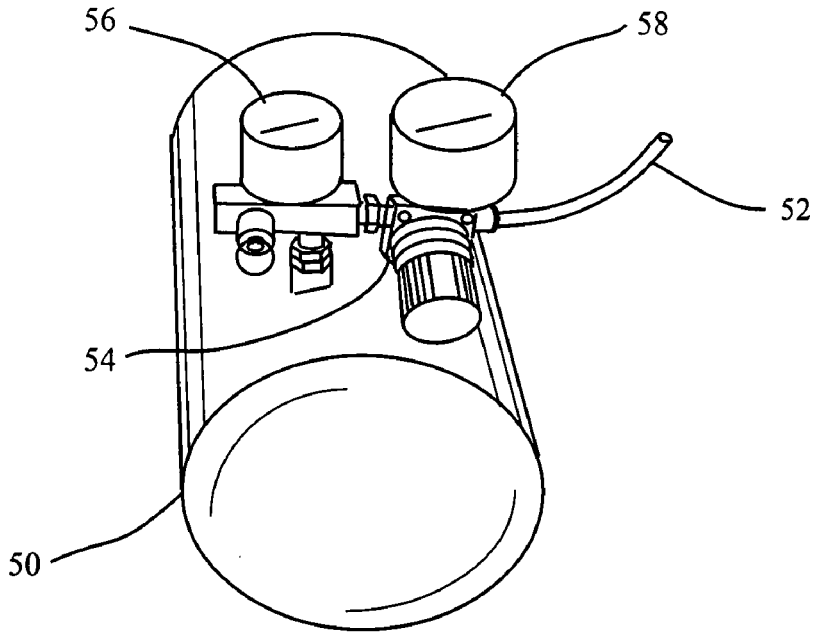
FIG. 8 shows an embodiment of a gas storage vessel which may be utilized for with the present invention.
Figure 9:
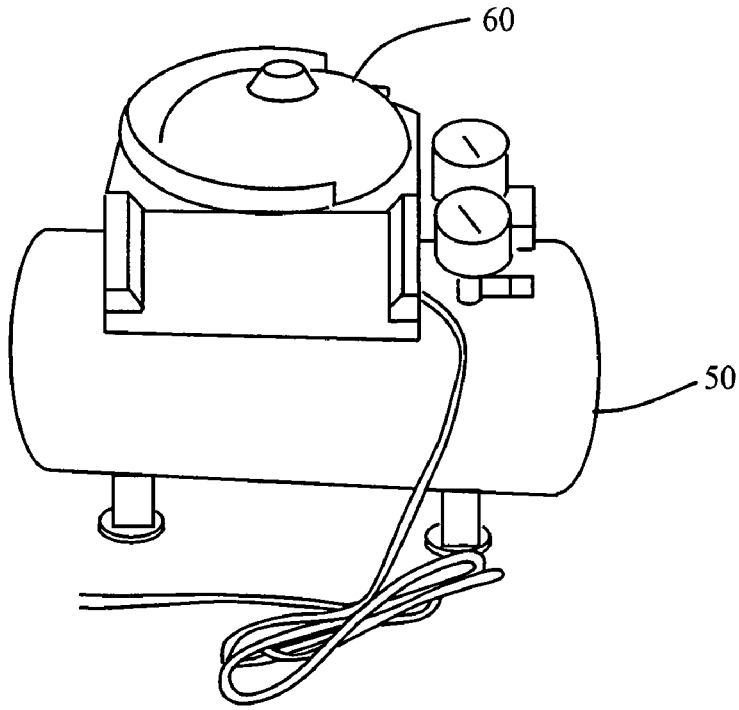
FIG. 9 shows an embodiment of a gas storage vessel which may be utilized for the present invention, wherein the gas storage vessel comprises an integrated compressor for refilling the storage vessel as desired.

One embodiment of the invention utilizes a pressurized gas storage vessel 50 as shown in FIGS. 7 through 9. The pneumatic actuating ram 22 may comprise a single acting spring return device, wherein the piston member 24 is biased back into cylinder member 26 when pneumatic pressure is released by the exhausting of gas through a vent. Flexible tubing 52 connects pressurized gas storage vessel 50 to the pneumatic actuating ram 22. Flexible tubing 52 may be utilized for conducting an inert gas, such as air, helium or nitrogen, into cylinder member 26 of pneumatic actuating ram 22. The use of flexible tubing 52 for supplying gas to pneumatic actuating ram 22 enables various components of the apparatus to be located at a variety of locations on the watercraft.

Pressurized gas storage vessel 50 may be stored in a variety of locations on the watercraft, depending upon the available storage. For example, for ski boat 10, the pressurized gas storage vessel 50 may be stored under the floor of the vessel or stored in seat storage compartments. For smaller watercraft, such as jet skis, a small pressurized gas storage vessel may be stored under the seat of the craft, or mounted to the side of the vessel.

Pressurized gas storage vessel 50 may further comprise a pressure regulator 54 which controls the gas pressure applied to pneumatic actuating ram 22. Pressurized gas storage vessel 50 may also comprise pressure gauge 56 for ascertaining the vessel pressure and pressure gauge 58 for ascertaining the pressure applied to the pneumatic actuating ram 22. As shown in FIG. 9, if air is used as the operating gas, an attached compressor 60 may be utilized to re-pressurize the pressurized gas storage vessel 50 when the tank pressure declines to a preset value. Compressor 60 may either be hardwired into the vessel's electrical system or, alternatively, operated from the vessel's cigarette lighter. A low pressure switch may be utilized to activate the compressor to re-pressurize the pressurized storage vessel 50 automatically upon the tank pressure declining to a preset value, and a high pressure switch employed to stop the compressor when the pressure in the pressurized gas storage vessel reaches the desired value.

As shown in FIG. 7, switching means, such as switch 62, may be used to control the flow of gas from pressurized gas storage vessel 50 to pneumatic actuating ram 22. When switch 62 is activated, an associated valve 72 is opened which allows the flow of gas from pressurized gas storage vessel 50 through flexible tubing 52 to pneumatic actuating ram 22. When switch 62 is deactivated, the valve closes, and gas in cylinder member 26 is exhausted through either valve 72, a vent, or through a separate exhaust valve activated by switch 62. Exhausting of the gas from pneumatic actuating ram 22 causes the piston member 24 to retract within the cylinder member 26.

As also shown in FIG. 7, switch 62 may also be used to make electrical contacts, thereby energizing status indicators for showing whether the flag 18 is in the first position or second position. For example, switch 62 may make electrical contacts causing light 64 to be energized to indicate the position of the flag 18. For example, because the flag 18 will normally be in a lowered position, it would be convenient to have light 64 illuminated when flag 18 is in a raised position. It is to be appreciated that a variety of pneumatic controls and/or electro-pneumatic controls may be utilized to control the introduction of gas into the pneumatic actuating ram 22, the evacuation of gas from the actuating ram, and status indicators showing the same. In addition, an audible alarm may be utilized to indicate that the flag 18 is in the raised position, if a certain amount of time elapses. For example, an audible alarm may be activated if the signal flag remains in the raised position for more than five minutes.

While the above is a description of various embodiments of the present invention, further modifications may be employed without departing from the spirit and scope of the present invention. Thus the scope of the invention should not be limited according to these factors, but according to the following claims.

What is claimed is:

1. An actuated signal flag for watercraft comprising:

a watercraft;

a mounting bracket attached to the watercraft;

a pivoting member rotationally attached to the mounting bracket, the pivoting member rotatable from a first position to a second position;

a pneumatic actuating ram operationally attached to the pivoting member, the pneumatic actuating ram having a piston member which extends from a cylinder member upon introduction of a gas into the cylinder chamber, said piston member retracting into the cylinder member upon exhausting of gas from the cylinder member, said piston member extension causing the pivoting member to rotate from the first position to the second position and said piston member retraction causing the pivoting member to rotate from the second position to the first position;

a remote activation means for selectively causing the pivoting member to rotate from the first position to the second position and from the second position to the first position, wherein the remote activation means comprises a switch operated valve, said valve opening upon activation of the switch and allowing air to flow from a gas storage vessel connected to the pneumatic actuating ram causing the pivoting member to rotate from the first position to the second position; and a signal flag attached to the pivoting member.

2. The actuated signal flag of claim 1 further comprising a compressor attached to the gas storage vessel.

3. The actuated signal flag of claim 1 wherein the watercraft comprises a tower and the mounting bracket is attached to the tower.

4. The actuated signal flag of claim 1 wherein the pivoting member comprises a first leg, a second leg, and a third leg.

5. The actuated signal flag of claim 4 wherein the first leg, the second leg, and the third leg are generally at right angles to one another.

6. The actuated signal flag of claim 1 wherein the flag attaches to the pivoting member with a flexible connector.

7. The actuated signal flag of claim 1 wherein the remote activation means comprises position indication means which indicate whether the flag is in the first position or the second position.

8. The actuated signal flag of claim 7 wherein the position indication means comprises a light which is energized when the flag is in the second position.

* * * * *